United States Patent [19]

Yen et al.

[11] 4,043,885

[45] Aug. 23, 1977

[54] ELECTROLYTIC PYRITE REMOVAL FROM KEROGEN MATERIALS

[75] Inventors: Teh Fu Yen, Altadena; Chaur-Shyong Wen, Los Angeles; Jonathan Kwan, Monterey Park, all of Calif.

[73] Assignee: University of Southern California, Los Angeles, Calif.

[21] Appl. No.: 716,860

[22] Filed: Aug. 23, 1976

[51] Int. Cl.[2] ..... C25B 3/00

[52] U.S. Cl. ..... 204/131; 204/130

[58] Field of Search ..... 204/130–131, 204/136; 75/1 R, 2 H

[56] References Cited

U.S. PATENT DOCUMENTS 3,915,819 10/1975 Bell et al. ..... 204/136

*Primary Examiner*—R. L. Andrews

*Attorney, Agent, or Firm*—Nilsson, Robbins, Dalgarn & Berliner

[57] ABSTRACT

An electrolytically active slurry of bituminous, kerogen-containing material is subjected to non-oxidative electrolysis to remove pyrite therefrom.

10 Claims, 7 Drawing Figures

ELECTROLYTIC PYRITE REMOVAL FROM KEROGEN MATERIALS

FIELD OF THE INVENTION

The invention relates to the removal of pyrite from bituminous material and, more specifically, from oil-bearing shale and from kerogen concentrates.

BACKGROUND AND SUMMARY OF THE INVENTION

Oil shale is a natural sedimentary rock containing an abundance of residual organic material which, when processed, can be made into oil and fuel products. Typically, oil shale, such as exemplified by the Green River formation in Wyoming, Colorado and Utah, has about 15–20% organic material embedded in an inorganic mineral matrix. The organic portion is composed generally of a soluble bitumen fraction and an insoluble fraction in which kerogen constitutes the bulk of the insoluble organic material. The bitumen fraction is readily solubilized by organic solvents and can be removed for refinement by physical means. The kerogen portion is characterized by its insolubility in organic solvents and is therefore more difficult to remove. In Green River oil shale, kerogen makes up about 75% of the organic components and in most all oil shale is the major organic component.

The inorganic mineral matrix in which the desired organics are trapped is composed primarily of carbonate materials such as dolomite and calcite, quartz and silicate minerals such as analcite or other zeolites, and will also usually contain substantial amounts of pyrite.

Several approaches have been used with oil shale for separating the organics from the mineral matrix. The usual process comprises crushing the matrix rock and subjecting the crushed matrix to heat in a retort to distill off the kerogen. Other processes involve erosion of the inorganics, for example by acid leaching, to keep the organics intact. Regardless of the method utilized, the kerogen retains a substantial amount of pyrite (iron sulfide) impurities. Such impurities form a major source of air pollution by sulfur dioxide during combustion. Many strong acids (e.g., hydrochloric, hydrofluoric or sulfuric acids) cannot dissolve pyrite from oil shales. While concentrated nitric acid can dissolve pyrite, it causes oxidation and nitration of the kerogen matrix. Pyrite has been removed by treatment of kerogen concentrate with lithium aluminum hydride in tetrahydrofuran solution at reflux temperature but with specific alteration of kerogen functional groups.

The present invention provides a process for removing pyrite from bituminous material, preferably kerogen-containing material, which does not adversely affect the organic residue. Specifically, an electrolytically active slurry of the material is formed and placed in the anode chamber of a cell having a cathode chamber electrolytically operative therewith. Substantially non-oxidative electrolysis is conducted by using a neutral salt electrolyte and/or by operation at low electrolyte concentrations, less than 1.0 N. The pyrite is electrolytically reacted, resulting in substantial removal of pyrite from the material. The electrolysis is preferably conducted at a current density above about 50 amperes per square meter of anode surface (50 $A/m^2$) for a period of at least half an hour until the pH of the slurry is reduced to less than about 1.5.

The process will be described with respect to the electrolysis of oil shale and of kerogen concentrate obtained therefrom, but is also applicable to coal, tar sands and other carbonaceous bitumens.

DETAILED DESCRIPTION

The following description will relate, for exemplification, to the processing of kerogen concentrate and of raw oil shale, in each case in an industrial plant environment. However, it is to be understood that the processes defined herein are also applicable directly to shale formation in situ, i.e., to shale deposits in the ground. In such case an electrolytic cell can be defined by the appropriate placement of anodes and cathodes in such deposits. A fortuitous result of such electrolytic treatment is a large increase in porosity and permeability of the shale deposit, which facilitates the release of gaseous fuel. Accordingly, the process as defined herein is meant to include such broader considerations.

Figure 1:
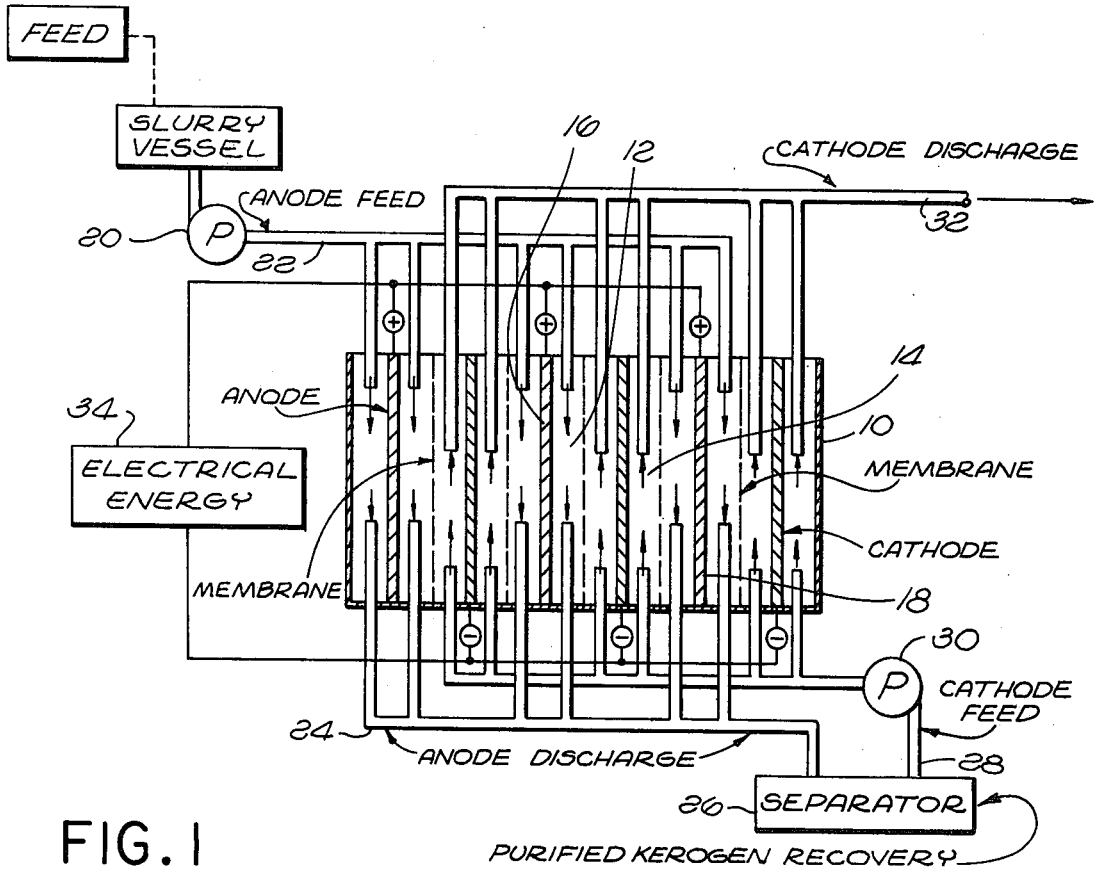
FIG. 1 is a block form flow diagram of the basic process using a tandem flow continuous cell.

Referring to FIG. 1, there is illustrated pyrite removal using a tandem flow continuous cell. Feed material in the form of ground oil shale or kerogen concentrate therefrom, or the like, is fed into a slurry vessel where it is formed into an electrolytically active slurry. In the case of raw oil shale which contains a substantial amount of alkali salts, it is necessary only to mix the ground material with water, stirring sufficiently to provide a fine slurry. The kerogen-containing material, whether oil shale or concentrate, or the like, is ground to a particle size preferably smaller than 60 mesh U.S. Standard, a suitable range being about 60 to 326 mesh U.S. Standard. It is preferred that slurring take place under at least agitated conditions such as is caused by a rotating impeller, or under grinding or pulverizing conditions such as would occur if the slurrying vessel were a ball mill. In the latter case, grinding and slurrying could take place simultaneously and such would be particularly applicable to the slurrying of raw oil shale.

As feed material, in the broader aspects of the invention, one could use various oil shales, coals, tar sands and other carbonaceous bitumens, or organic materials therefrom which are insoluble in organic solvents and which are obtained in concentrated form by any of a number of appropriate processes. The present process is particularly suitable for application to oil shales and kerogen concentrates therefrom.

To avoid excessive destruction of the organic components, a neutral salt electrolyte should be used; otherwise the electrolysis should be operated at an electrolyte concentration of less than 1.0 N. When a neutral salt is used, the electrolyte concentration can be from 01. N up to saturation, but generally an upper concentration of about 4 N is satisfactory. The chlorides of sodium, potassium, barium and calcium, or mixtures thereof, or the like, can be used as electrolyte salts. An alkali metal salt, exemplified by sodium chloride and potassium chloride, or mixtures of such salts, are preferred since such salts exist in large amounts in oil shale. Accordingly, the internal permeability of the system should increase with use. It is preferred that the slurry of feed material and electrolyte solution be acidic, with an acidity preferably less than about pH4 and above about 0.5. Current efficiency is reduced at pH's above 4 and at very high acidities in the absence of substantial concentrations of the electrolyte salt.

The slurried material is subjected to electrolytic treatment which is carried out in an electrolytic cell 10 divided into a series of anode chambers 12 and cathode chambers 14, each including therein respective anodes 16 and cathodes 18. The chambers 12 and 14 are preferably divided by inert membranes which are resistant to attack by the electrolyte. For example, a cation-porous membrane such as sold commercially under the trademark DuPont Nafion Membrane 425 (a perfluorosulfonic acid product) can be used. Alternatively, one can use a rigid porous frit having an average porosity in the range of about 20μ–100μ. Of course, the membranes or frit should be substantially impermeable to the electrolyte flowing in the chambers but must permit the flow of electricity through the electrolyte which saturates the membrane or frit.

As electrodes, one can use any commonly used electrodes which are resistant to the electrolyte solution, for example, graphite, stainless steel, copper, copper-silicon, aluminum oxide, lead and the like. Platinum can be used for small production runs. For large commercial installations, carbon anodes and lead sheet cathodes are preferred. A direct current potential is applied by means of a source 34 of electrical energy connected to the anodes 16 and cathodes 18.

The slurry of feed material and electrolyte from the slurry vessel is fed by means of a pump 20 to an anode feed manifold line 22. The pumps used with the electrolytic cell 10 are preferably of the non-air entraining type, such that they exclude air from being comixed with the fluid being pumped therethrough. The manifold line delivers the slurry to the top of the anode chambers 12 on opposite sides of the anodes 16. The anolyte emerges through valving (not shown), at the bottom of the anode chambers 12 to an anode discharge line 24 leading into a separator 26 from which purified feed material is recovered. The separator 26 can be simply a settling column in which the feed material settles by gravity while the aqueous liquid is drawn off through appropriate filters. Any other structure can be utilized, batch-wise or continuously, such as a centrifugal separator, or the like. The aqueous liquid from the separator 26 is drawn off into a manifold cathode feedline 28 and fed by means of a pump 30 to the bottom ends of the cathode chambers 14 on opposite sides of the cathode 18. The catholyte emerges from the cathode chambers 14 into a cathode discharge line 32.

The major anodic reaction involving pyrite decomposition may be expressed by the following equation:

$$FeS_2 + 8H_2O \rightarrow Fe^{+++} + 2SO_4^{=} + 16H^+ + 15e^-$$

During electrolysis, the acidity of the anode discharge can be monitored. The feed rate can then be modified to provide a residence or dwell time sufficient so that the discharged anolyte has an acidity of less than 1.5 pH.

The catholyte is discharged to a further treatment station wherein iron is recovered, chemically or electrolytically, and wherein other valuable metals as are found in oil shale deposits are recovered as by-products. See in this regard, the publication "Hydrometallurgy", *Advances in Chemical Engineering,* Academic Press, New York, 1974, vol. 9, chapter 1, by R. G. Bautista, incorporated herein by reference. Thereafter, the electrolyte can be lead directly back to the slurry vessel for recombination with additional feed material, in a closed-loop process.

The electrolytic cell depicted in FIG. 1 is of generally known configuration, other types also being suitable. The process can be used at room temperature although higher temperatures can be used if warranted by savings in applied current.

The current density of the applied potential generally should be above about 50 amperes per square meter (50 $A/m^2$) and can range up to 1500 $A/m^2$. Dwell time in the electrolytic cell should average at least about 0.2 hour at the upper level of current density to several days if necessary at the lower levels, depending of course upon pyrite concentration, electrolyte composition, particle size of the feed, acidity of the electrolyte, and operating temperature. The present procedure is exemplified, with a particular Appalachian oil shale, by a current density of about 350–750 $A/m^2$ for about 1–5 hours to effect substantial removal of pyrite.

Figure 6:
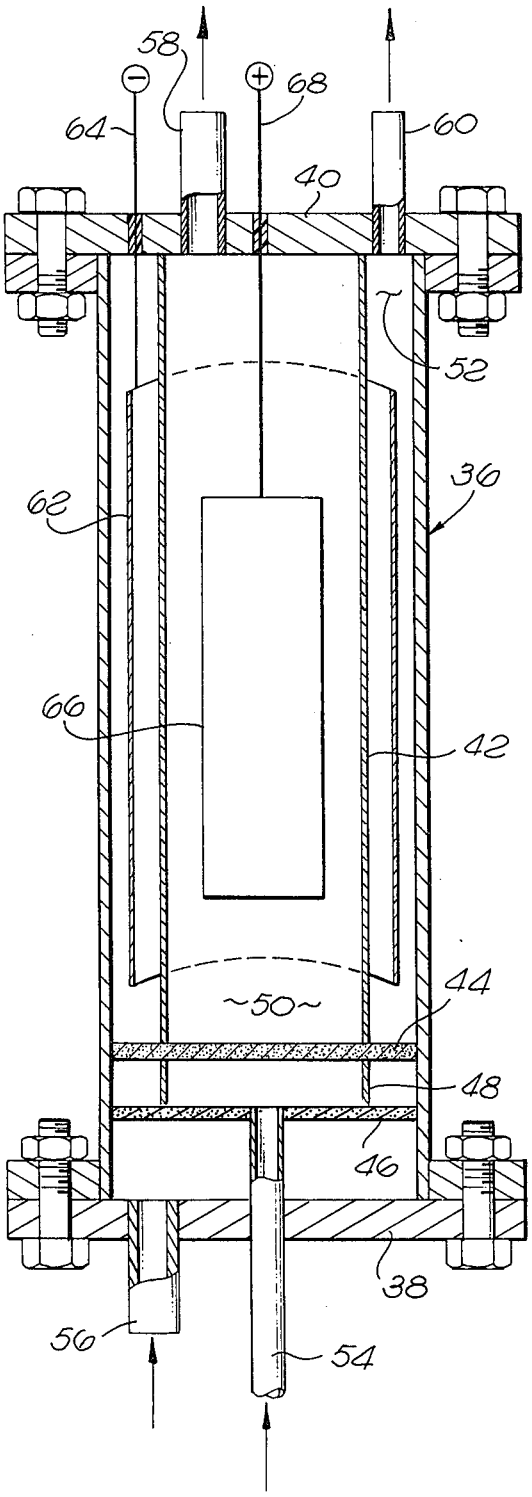
FIG. 6 is a cross-sectional view of a second, co-flow, form of continuous cell.

Referring to FIG. 6, a co-flow continuous cell is illustrated. The cell comprises a tubular outer shell 36, the ends of which are closed by bottom and top walls 38 and 40, respectively. An elongate tubular, rigid porous alundum diaphragm 42 is supported within and spaced from the outer shell 36 on a pair of top and bottom distributor plates 44 and 46, respectively, spaced one from the other by a short spacer ring 48. The bottom distributor plate is secured spaced from the inner surface of the bottom shell wall 38. The top end of the diaphragm 42 abuts the inner surface of the top shell wall 40 to define an anode chamber 50 therewithin and a cathode chamber 52 between its outer surface and the inner surface of the shell 36. The diaphragm 42 has a porosity range of about 50μ to 100μ, is sufficiently porous to permit the flow of electricity therethrough, but is substantially impermeable to the oil shale sample.

A sample tube 54 extends through the bottom shell wall 38 and bottom distributor plate 46, into the space below the top distributor plate 44. An electrolyte inlet tube 56 also extends through the bottom shell wall 38 but terminates below the bottom distributor plate 46. The top shell 40 is fitted with a sample outlet tube 58 and electrolyte outlet tube 60. The sample outlet tube 58 is located so as to serve as an anolyte outlet from the anode chamber 50. The electrolyte outlet tube 60 is located so as to serve as a catholyte outlet from the cathode chamber 52.

The top distributor plate 44 is sufficiently porous, e.g. 550μ to 1000μ, to permit easy flow of feed material slurry into the anode chamber 50. The bottom distributor plate 46 is sufficiently porous to permit easy flow of electrolyte but is preferably substantially impermeable to the feed slurry, e.g. about 10μ to 75μ. During operation, flow is constant, toward the outlets, but during interruptions, the bottom distributor plate 46 limits back-flow of feed slurry into the cathode chamber. Modifications can be made which, while departing from optimum operation, nevertheless provide a workable process.

Figure 7:
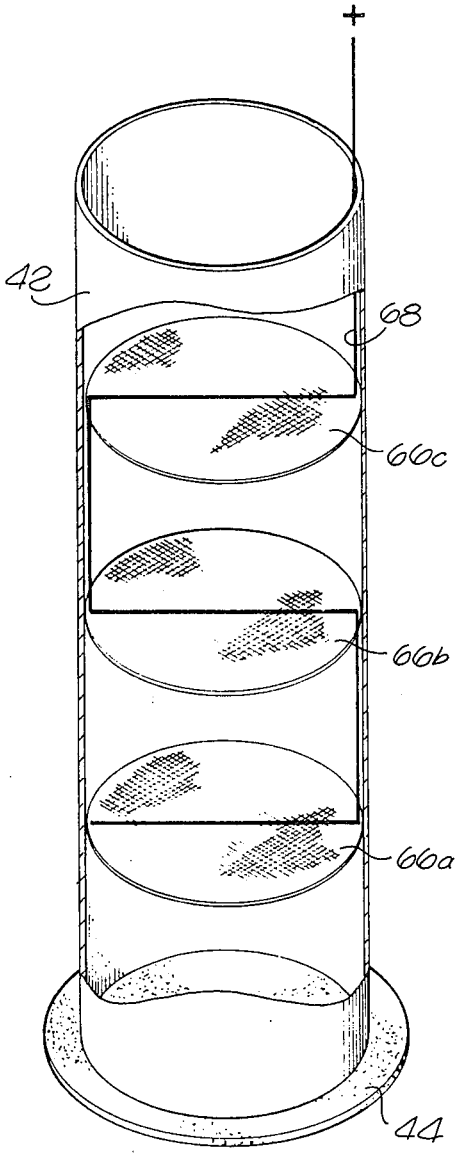
FIG. 7 is a perspective, partially cut-away view of the anode chamber of the continuous cell of FIG. 2.

A lead sheet cathode 62 rolled around, but spaced from the diaphragm 42, is sealed in the cathode chamber through the upper shell wall 40 by means of a copper wire 64. Referring additionally to FIG. 7, an anode (shown schematically at 66 in FIG. 6) is defined by three circular discs 66*a*, 66*b* and 66*c*, each formed by 45 mesh platinum gauze horizontally secured within the diaphragm and soldered with a length of copper wire 68 in S shape and sealed through the upper shell wall 40.

In operation, a slurry of feed material and electrolyte is pumped through the sample inlet tube 54 into the anode chamber 50 while electrolyte is fed through the electrolyte inlet tube 56. Alternatively, feed material in high concentration slurried only with water, can be pumped through the sample inlet tube 54 to be mixed with electrolyte solution in the space between the top and bottom distributor plates. Anolyte and catholyte are withdrawn from the outlet tubes 58 and 60. Processing conditions are in the same ranges as given for the cell of FIG. 1.

The following Examples will illustrates application of the process.

EXAMPLE 1

A kerogen concentrate was prepared from a raw sample of Appalachian shale. The shale was analyzed and the total carbon, organic carbon, hydrogen, nitrogen and sulfur analysis is shown in Table 1. A semiquantative inorganic spectrographic analysis is shown in Table 2.

TABLE 1

APPALACHIAN SHALE

| Component | Wt. % of Shale |
|---|---|
| Total carbon | 9.14 |
| Organic carbon | 7.84 |
| Hydrogen | 1.33 |
| Nitrogen | 0.18 |
| Sulphur | 0.11 |

TABLE 2

SEMIQUANTITATIVE SPECTROGRAPHIC ANALYSES

| Element | Wt. % of Shale |
|---|---|
| Si | 23 |
| Al | 8.7 |
| K | 7.4 |
| Fe | 4.4 |
| Na | 2.2 |
| Mg | 1.1 |
| Ti | 0.89 |
| Ca | 0.17 |
| V | 0.13 |
| Sr | 0.087 |
| Cr | 0.075 |
| Mo | 0.035 |
| Mn | 0.034 |
| Zr | 0.029 |
| Cu | 0.013 |
| B | 0.0084 |
| Ni | 0.0026 |

The oil shale was ground to pass a 100 mesh screen, U.S. Standard and 10 grams were extracted with 100 milliliters of benzene to remove soluble organic material (bitumen). The extracted shale was treated with 100 milliliters of 10% (specific gravity 1.18) hydrochloric acid to react with carbonate materials. The resultant residue was filtered, washed and treated with 50 milliliters of a 1:1 by volume mixture of concentrated hydrofluoric acid (48%) and hydrochloric acid (37%). The mixture was filtered and the residue was washed repeatedly with boiling water until the filtrate was neutral. The residue was then dried at 75° C in an oven for 8 hours to obtain a kerogen concentrate. The kerogen concentrate was analyzed for carbon, hydrogen, sulfur and nitrogen, the results being given in Table 3 below.

Electrolytic removal of pyrite from the kerogen concentrate was carried out using an H-type covered cell of 150 milliliter total capacity. One-half of the H-type cell defined an anode compartment while the other half defined a cathode compartment separated from the anode compartment by a porous frit in the horizontal connecting conduit of the H-type cell. An anode was formed of 45-mesh platinum gauze (2.5 × 5 centimeters; Fisher Scientific Co., Pittsburgh, Pa.) rolled into a cylinder and supported within the anode chamber by a platinum wire leading through a cement seal in the neck of the cell. A lead sheet (12 centimeters square) served as the cathode and was connected by means of a platinum wire through a cement seal in the neck of the cathode chamber. The anode platinum wire was connected through an ammeter to one side of a voltage adjuster while the cathode platinum wire was connected to the other side of the voltage adjuster. A voltmeter was connected across the anode and cathode platinum wires.

The samples were mixed with 50 milliliters of 0.5N aqueous sodium chloride as electrolyte to form a slurry and the slurry was placed in the anode compartment along with a magnetic stirrer. 4 runs were conducted in which a direct current of either 35 or 75 Ma/cm$^2$ (350 or 750 A/m$^2$) was applied. The current density was maintained constant throughout each run, by adjustment of the potential, which was in the range of 5 to 12 volts. Upon completion of each run, the pH was determined and the residue from the anode chamber was filtered and washed well with hot water. The residue was transferred to a round flask, dried by a stream of nitrogen and put into an oven at 75° C until weight-stabilized. The dried residue was analyzed for carbon, hydrogen, sulfur and nitrogen. Table 3 compares the analysis with the original kerogen concentrate.

TABLE 3

ANALYSIS OF KEROGEN CONCENTRATE

| Sample | current density (A/m$^2$) | time (hours) | weight % C | H | S | N | H/C atomic ratio |
|---|---|---|---|---|---|---|---|
| untreated | — | — | 64.1 | 5.5 | 6.22 | 1.81 | 1.03 |
| a | 35 | 2 | 58.9 | 4.78 | 1.38 | 1.49 | 0.97 |
| b | 75 | 2 | 59.5 | 4.79 | 1.27 | 1.51 | 0.97 |
| c | 75 | 1 | 60.7 | 4.89 | 1.35 | 1.66 | 0.97 |
| d | 75 | 5 | 49.8 | 4.05 | 0.33 | 1.47 | 0.98 |

The elemental composition of the original and electrolyzed kerogen concentrates in Table 3 indicates about 75–95% total sulfur removal after 1–5 hours of electrolytic treatment. The decrease in nitrogen content of about 8–19% could be due to oxidation of nitrogen-containing compounds. The small decrease in the atomic ratio of hydrogen to carbon, from 1.03 to 0.97–0.98, suggests that some heterocyclic compounds (for example, amides) have been oxidized during the anodic pyrite removal.

Sulphate sulfur formed in the anodic filtrate was analyzed and proved equivalent to about 4.5–4.9% sulfur released (based on the original weight of the concentrate). These values are compared in Table 4 with the total sulfur removal derived from the elemental analysis of Table 3, and corresponds to 83–95% conversion of the released sulfur to sulfate.

TABLE 4

SULPHATE SULPHUR IN ANODIC FILTRATE (WT. %)

| Sample | original sulfur | sulphur remaining | sulphur removed | filtrate sulphate sulphur | % converted |
|---|---|---|---|---|---|
| a | 6.22 | 1.38 | 4.84 | 4.5 | 93.0 |
| b | 6.22 | 1.27 | 4.95 | 4.7 | 95.0 |
| c | 6.22 | 1.35 | 4.87 | 4.5 | 92.4 |
| d | 6.22 | 0.33 | 5.89 | 4.9 | 83.2 |

During the 2 hour electrolytic removal of pyrite in samples "*a*" and "*b*", the acidity of the anodic solution changed rapidly during the first hour from pH 3.7 to 1.3, then asymptotically to 1.1, indicating that the electrolytic reaction of sulphides was accompanied by acidification.

Figure 2:
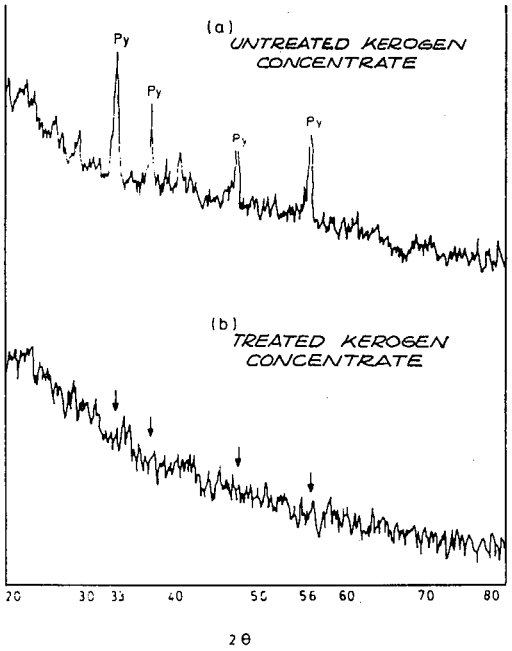
FIG. 2 is an X-ray diffraction spectra of kerogen cencentrates, untreated and treated in accordance with the present invention.

The removal of pyrite was qualitatively demonstrated by obtaining X-ray diffraction spectra of the untreated kerogen concentrate and treated kerogen concentrate of sample "*a*", using the major pyrite peaks at 33°, 37°, 48° and 56° ($2\theta$). The spectra is shown in FIG. 2 and it will be seen that the only substantial change is the removal of the pyrite peaks.

Figure 3:
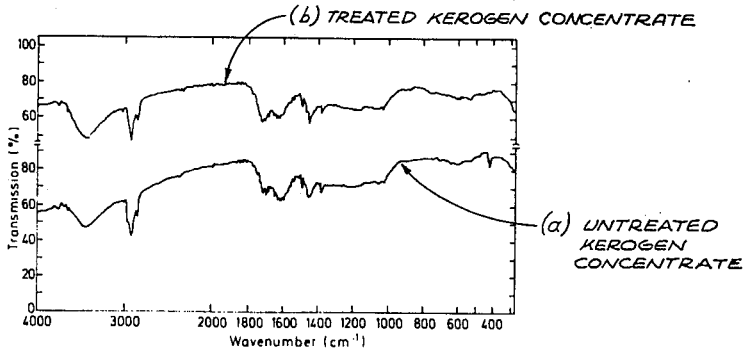
FIGS. 3 and 4 are infrared spectra of kerogen concentrates, untreated and treated in accordance with the present invention.
Figure 4:
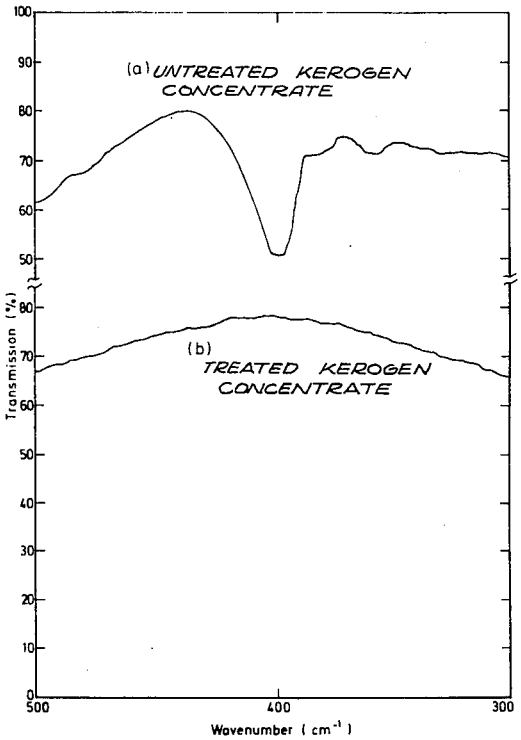

The same kerogen compositions were analyzed by infrared spectroscopy (Beckman Model Acculad 6) and the spectra is shown in FIG. 3. It will be seen that there is no significant alteration of the kerogen composition except in the region of about 400 wave number ($cm^{-1}$). Extended spectra in this region, showing pyrite removal, is depicted in FIG. 4.

EXAMPLE 2

Figure 5:
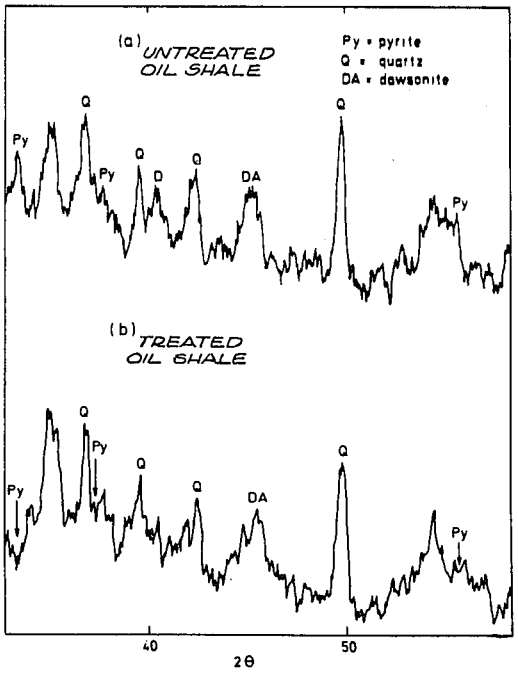
FIG. 5 is an X-ray diffraction spectra of raw oil shale, untreated and treated in accordance with the present invention.

The electrolysis described in Example 1 was repeated except that in place of the kerogen concentrate, 10 grams of raw oil shale, ground to pass a 100 mesh screen, U.S. Standard was utilized as the feed material. A current density of 500 $A/m^2$ for 5 hours was used and maintained constant by adjustment of potential which was in the range of 5 to 15 volts. X-ray diffraction spectra of the untreated oil shale and product is shown in FIG. 5. It will be seen that while quartz and dawsonite peaks remain substantially undisturbed, the pyrite peaks have vanished.

EXAMPLE 3

200 mesh raw appalachian shale was mixed with 0.5 N aqueous sodium chloride and the mixture was pumped into the anode chamber of a co-flow continuous cell as shown in FIG. 6. A flow rate of 4 ml/minute was maintained at a current density of 500 $A/m^2$ by adjustment of the potential which was in the range of 5 to 10 volts. The anolyte and catholyte were collected from the outlet tubes 58 and 60. Pyrite removal was confirmed by X-ray diffraction and infrared analysis.

Various modifications, changes and alterations can be made in the present process and its steps and parameters. All such modifications, changes and alterations as are within the scope of the appended claims form part of the present invention.

We claim:

1. A process for treating bituminous material for removal of pyrite therefrom, comprising:

forming an aqueous, substantially non-oxidative electrolytically active slurry of said material;

defining an electrolytic cell having a cathode chamber electrolytically operative with an anode chamber, an anode in said anode chamber in contact with said slurry and a cathode in said cathode chamber; and applying a direct current potential across said anode and cathode chambers at a current density of above about 50 $A/m^2$ to effect an electrolytic reaction of the pyrite in said material for a time sufficient for substantial removal of pyrite from said material.

2. The process of claim 1 in which said bituminous material contains kerogen as its major organic component.

3. The process of claim 2 in which said bituminous material comprises a kerogen concentrate obtained by extraction of organic solvent-soluble bitumen, and leaching of carbonate minerals, from oil shale.

4. The process of claim 3 in which the electrolytic activity of said slurry is obtained by adding an alkali metal salt as electrolyte.

5. The process in claim 1 in which said bituminous material comprises raw oil shale.

6. The process of claim 5 in which the electrolytic activity of said slurry is obtained by the presence of alkali metal salt in said oil shale.

7. The process of claim 1 in which the electrolyte in said slurry is a neutral salt.

8. The process of claim 1 in which said slurry has an electrolyte concentration of 0.1–1.0 N.

9. The process of claim 1 in which said electrolyte is conducted until acidity is reduced to less than 1.5 pH.

10. A process for treating raw oil shale for removal of pyrite therefrom, comprising:

grinding said oil shale to pass at least a 60 mesh screen, U.S. Standard;

adding an organic solvent for bitumen to said ground shale to solubilize bitumen in said shale, and extracting said solubilized bitumen;

adding a mineral acid to said extracted shale for leaching carbonate minerals;

washing to remove residual acid and reaction products of said leaching to obtain a kerogen concentrate;

slurrying said kerogen concentrate with a dilute aqueous solution of alkali metal salt, as electrolyte;

placing said slurry into the anode chamber of an electrolytic cell having a cathode chamber electrolytically operative with said anode chamber; and applying a direct current potential across said anode and cathode chambers at a current density of about 350–750 $A/m^2$ for about 1–5 hours to effect electrolytic reaction of the pyrite in said kerogen concentrate for substantial removal of pyrite from said kerogen.

* * * * *

UNITED STATES PATENT AND TRADEMARK OFFICE

CERTIFICATE OF CORRECTION

PATENT NO. : 4,043,885
DATED : August 23, 1977
INVENTOR(S) : Teh Fu Yen et al

It is certified that error appears in the above-identified patent and that said Letters Patent are hereby corrected as shown below:

Col. 2, line 10, "cencentrates" should be --concentrates--.

Col. 2, line 49, "slurring" should be --slurrying--.

Col. 4, lines 48, after "sample" insert --inlet--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*